US009520098B2

(12) United States Patent
Li et al.

(10) Patent No.: US 9,520,098 B2
(45) Date of Patent: Dec. 13, 2016

(54) GATE DRIVING CIRCUIT, DISPLAY DEVICE AND DRIVING METHOD

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Hongmin Li, Beijing (CN); Xiaohe Li, Beijing (CN); Xiaojie Zhang, Beijing (CN); Xianjie Shao, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 14/424,917

(22) PCT Filed: May 28, 2014

(86) PCT No.: PCT/CN2014/078638

§ 371 (c)(1),
(2) Date: Feb. 27, 2015

(87) PCT Pub. No.: WO2015/096385

PCT Pub. Date: Jul. 2, 2015

(65) Prior Publication Data

US 2016/0027396 A1 Jan. 28, 2016

(30) Foreign Application Priority Data

Dec. 25, 2013 (CN) ..... 2013 1 0726355

(51) Int. Cl.
*G09G 5/00* (2006.01)
*G09G 3/36* (2006.01)

(52) U.S. Cl.
CPC ..... *G09G 3/3677* (2013.01); *G09G 3/3614* (2013.01); *G09G 2300/0426* (2013.01);
(Continued)

(58) Field of Classification Search
CPC ..... G09G 3/36; G09G 3/3614; G09G 3/3677; G09G 2310/08; G09G 2310/0218; G09G 2310/0289; G09G 2300/0426
(Continued)

(56) References Cited

U.S. PATENT DOCUMENTS 8,411,074 B2 * 4/2013 Liu ..... G09G 3/20 345/100
9,218,780 B2 * 12/2015 Chen ..... G09G 3/3266
(Continued)

FOREIGN PATENT DOCUMENTS

CN 101471042 A 7/2009
CN 101577104 A 11/2009
(Continued)

OTHER PUBLICATIONS

Second Chinese Office Action for Chinese Application No. 201310726355.4, dated Jan. 4, 2016.
(Continued)

*Primary Examiner* — Vijay Shankar
(74) *Attorney, Agent, or Firm* — Kinney & Lange, P.A.

(57) ABSTRACT

A gate driving circuit, a display device, and a driving method are disclosed in the present invention. The gate driving circuit comprises: a plurality of cascaded shift register units and a control unit, wherein every two adjacent shift register units constitute a shift register set and are connected to two gate lines through the control unit, and wherein the control unit controls the shift register units of the shift register set to supply drive signals to the two gate lines, respectively. Embodiments of the present invention improve a configu-
(Continued)

ration of the circuit on the basis of original shift registers, thereby achieving compensation of charge rations between different frames and effectively alleviating phenomena of apparent bright/dark lines such as the vertical lines of the existing products.

17 Claims, 3 Drawing Sheets

(52) U.S. Cl.
CPC ..... *G09G 2310/0218* (2013.01); *G09G 2310/0289* (2013.01); *G09G 2310/08* (2013.01)

(58) Field of Classification Search
USPC ..... 345/87–100, 204–215
See application file for complete search history.

(56) References Cited

U.S. PATENT DOCUMENTS

| | | | | |
|---|---|---|---|---|
| 2008/0191968 | A1 | 8/2008 | Kawabe | |
| 2009/0278782 | A1 | 11/2009 | Chen | |
| 2010/0238143 | A1* | 9/2010 | Liu | G09G 3/20 345/204 |

FOREIGN PATENT DOCUMENTS

| | | | |
|---|---|---|---|
| CN | 101727800 | A | 6/2010 |
| CN | 201673656 | U | 12/2010 |
| CN | 102117593 | A | 7/2011 |
| CN | 103295643 | A | 9/2013 |
| CN | 103413532 | A | 11/2013 |
| CN | 103761944 | A | 4/2014 |
| KR | 20110077211 | A | 7/2011 |

OTHER PUBLICATIONS

International Search Report and Written Opinion dated Sep. 24, 2014 for PCT/CN2014/078638 in Chinese.
English Translation of Chinese Search Report dated May 6, 2015 received for corresponding Chinese Application No. 201310726355.4.
English Translation of Chinese Office Action dated May 6, 2015 received for corresponding Chinese Application No. 201310726355.4.

* cited by examiner

GATE DRIVING CIRCUIT, DISPLAY DEVICE AND DRIVING METHOD

BACKGROUND OF THE INVENTION

1. Field of the Invention

The embodiments of the present invention relate to the field of display, and particularly to a gate driving circuit, a display device, and a driving method.

2. Description of the Related Art

At present, a thin film transistor liquid crystal display (TFT-LCD) has become a mainstream display. The liquid crystal display has undergone a qualitative leap due to application of the gate-driver on array (GOA) technology in the liquid crystal display. Manufacturing steps and costs can be reduced by use of the GOA technology in which gate driver integrated circuits are manufactured directly on an array substrate in a liquid crystal display panel, instead of driver chips manufactured by externally connected chip. However, in an existing dual-gate design of the liquid crystal display panel to which the GOA technology is applied, gate driving can achieve only a positive Z scanning, thereby sufficiently charging one column of pixel units in the liquid crystal display panel and insufficiently charging another column of pixel units in the liquid crystal display panel. As a result, phenomena, such as poor vertical lines (V-lines), tend to occur. This will be described as below by an example in which a dual-gate liquid crystal display panel is driven in 1+2-dot inversion as shown in FIG. 1.

FIG. 1 shows a circuit diagram of an array substrate of a liquid crystal display panel in the prior art. As shown in FIG. 1, the array substrate comprises a plurality of data lines 1, a plurality of gate lines 2 (Gate 1-Gate 8), and a plurality of pixel units defined by the plurality of data lines and the plurality of gate lines. The plurality of pixel units form an array of pixel units. Each pixel unit is connected to one gate line and one data line through one thin film transistor (TFT). The gate line is connected to a gate of the thin film transistor, and the data line is connected to a source of the thin film transistor. Among each row of pixel units, the pixel units in odd-numbered columns are connected to the same gate line, the pixel units in the even-numbered columns are connected to another gate line, and the pixel units in two adjacent columns are connected to the same data line. The plurality of data lines 1 are driven by a data driving circuit, and receive data signals outputted by the data driving circuit. The plurality of gate lines 2 are connected to a gate driving circuit, and the gate driving circuit comprises a plurality of shift register units SR1-SR8. The plurality of shift register units are sequentially turned on and off during one frame scan and pulse signals generated by the plurality of shift register units SR1-SR8 after being turned on are outputted to the plurality of gate lines 2, respectively. After the frame scan begins, in a first scanning period, a first shift register unit SR1 is turned on and outputs a pulse signal to a first gate line Gate 1 so that the thin film transistors of the pixel units in the odd-numbered columns of a first row are turned on, the corresponding data lines receive data signals to charge the pixel units in the odd-numbered columns of the first row, and corresponding data are stored; and in a second scanning period, the first shift register unit SR1 is turned off, and a second shift register unit SR2 is turned on and outputs a pulse signal to a second gate line Gate 2, and at this time, the thin film transistors of the pixel units in the even-numbered columns of the first row are turned on, and the corresponding data lines charge the pixel units in the even-numbered columns of the first row. Then, a third shift register unit, a fourth shift register unit, and the like are sequentially turned on and output pulse signals to charge the corresponding pixel units in cooperation with the corresponding data lines. A polarity of data outputted to the data lines in each scanning period is inversed and polarities of data in the two adjacent data lines within each scanning period are also opposite to each other. Therefore, if a polarity of a data signal received by the pixel units in the odd-numbered columns of the first row is positive in the first scanning period, a polarity of a data signal received by the pixel units in the even-numbered columns of the first row will be changed from a positive polarity to a negative polarity in the second scanning period. In consideration of loads of the data lines, a charging time and a charge ratio of the pixel units in the even-numbered columns of the first row will be affected. The pixel units in the even-numbered columns of the first row are insufficiently charged compared with the pixel units in the odd-numbered columns of the first row. In a third scanning period, a third shift register SR3 outputs a pulse signal to a third gate line Gate 3 so that the pixel units in the odd-numbered columns of a second row begin to be charged. At this time, since a polarity of data signals in the data lines has been negative, a charging time and a charge ratio of the pixel units in the odd-numbered columns of the second row are relatively sufficient. However, the pixel units in the even-numbered columns of the second row will also be insufficiently charged. In conclusion, when the 1+2-dot inversion is performed, in the liquid crystal display panel based on the above configuration and inversion manner, the pixel units in the odd-numbered columns will be always charged more sufficiently than the pixel units in the even-numbered columns. When a difference between the charge ratios of the pixel units in the odd-numbered columns and the pixel units in the even-numbered columns is great, a displaying effect will be adversely affected. In other words, poor vertical lines are generated.

Therefore, when a product is designed, it is necessary to change the configuration and driving manner of the array substrate in order to avoid the difference between the charge ratios of the pixel units in the odd-numbered columns and the pixel units in the even-numbered columns, to alleviate the poor vertical lines.

SUMMARY OF THE INVENTION

In order to solve one or more of the above problems existing in the prior art, embodiments of the present invention improve a configuration of the gate driving circuit on the basis of the conventional shift registers, thereby achieving compensation of charge rations between different frames and alleviating relevant poor phenomena such as the vertical lines (V-lines) of the existing products.

In accordance with an aspect of the present invention, there is provided a gate driving circuit comprising a plurality of cascaded shift register units and a control unit, wherein every two adjacent shift register units constitute a shift register set and are connected to two gate lines through the control unit, and wherein the control unit controls the shift register units of the shift register set to supply drive signals to the two gate lines, respectively.

Optionally, the control unit comprises a first control line, a second control line, and thin film transistors connected to the shift register units.

Optionally, each shift register unit of the shift register set is connected to the first control line and the second control line through two of the thin film transistors, respectively, and the two thin film transistors comprise gates respectively connected to the first control line and the second control line, drains respectively connected to the two gate lines, and sources respectively connected to outputs of the shift register units.

Optionally, the control unit controls supplies of the drive signals from the shift register units of the shift register set to respective ones of the two gate lines.

Optionally, the first control line and the second control line alternately output high-electric potential drive signals.

Optionally, the two gate lines are connected respectively to pixel units in odd-numbered columns and pixel units in even-numbered columns, of an array of pixel units.

Optionally, the gate lines and the pixel units are connected to one another through pixel unit thin film transistors, and the pixel unit thin film transistors each have a gate connected to the gate line, a drain connected to a pixel electrode of the respective pixel unit, and a source connected to the data line.

In accordance with another aspect of the present invention, there is provided a display device comprising the above-mentioned gate driving circuit.

Optionally, the display device comprises N rows by M columns of pixel units, 2N gate lines, and M/2 data lines, wherein the 2N gate lines and the M/2 data lines cross one another to define the pixel units, odd-numbered ones of the gate lines are connected respectively to the pixel units in the odd-numbered columns, even-numbered ones of the gate lines are connected respectively to the pixel units in the even-numbered columns, the pixel units in every two adjacent columns of the odd-numbered columns and the even-numbered columns are connected to a same one of the data lines, and the two gate lines are one of the odd-numbered gate lines and one of the even-numbered gate lines that are adjacent to each other.

In accordance with another aspect of the present invention, there is provided a driving method of the abovementioned display device, the driving method comprising:

a current frame scan step: turning on and off the cascaded shift register units in sequence and controlling, by the control unit, supply of a drive signal from the turned-on ones of the shift register units to an odd-numbered or even-numbered one of the two gate lines; and a next frame scan step: turning on and off the cascaded shift register units in sequence and controlling, by the control unit, supply of a drive signal from the turned-on ones of the shift register units to an even-numbered or odd-numbered one of the two gate lines.

Optionally, the current frame scan step comprises:

turning on a first shift register unit of an n-th shift register set of the shift register sets, and controlling, by the control unit, supply of a drive signal from the turned-on first shift register unit to an odd-numbered one of the two gate lines connected to the first shift register unit, and charging the pixel units in odd-numbered columns of an n-th row through the data lines; and turning on a second shift register unit of the n-th shift register set, and controlling, by the control unit, supply of a drive signal from the turned-on second shift register unit to an even-numbered one of the two gate lines, and charging the pixel units in even-numbered columns of the n-th row through the data lines; and Optionally, the next frame scan step comprises:

turning on the first shift register unit of the n-th shift register set, and controlling, by the control unit, supply of a drive signal from the turned-on first shift register unit to the even-numbered one of the two gate lines connected to the first shift register unit, and charging the pixel units in the even-numbered of the n-th row through the data lines; and turning on the second shift register unit of the n-th shift register set, and controlling, by the control unit, supply of a drive signal from the turned-on second shift register unit to the odd-numbered one of the two gate lines, and charging the pixel units in the odd-numbered columns of the n-th row through the data lines; and wherein charging polarities of the pixel units in two adjacent ones of the rows are opposite to each other, charging polarities of the pixel units in two adjacent ones of the columns that are connected to a same one of the data lines are opposite to each other, charging polarities of the pixel units in two adjacent ones of the columns that are connected to different ones of the data lines are the same, and n is a natural number less than or equal to N.

By providing the control unit in the gate driving circuit, embodiments of the present invention improve a configuration of the gate driving circuit so that the control unit controls supplies of drive signals from two adjacent ones of the shift register units to two adjacent ones of the gate lines, respectively, and in two consecutive frame scans, the two shift register units supply drive signals to different ones of the gate lines. With the solution according to the present invention, when a display device is driven in a dot inversion driving manner, charging sequences of the pixel units in the odd-numbered and in even-numbered columns are different from each other in two consecutive frame scans such that the pixel units in the odd-numbered or the pixel units in even-numbered columns are sufficiently charged in the current frame, but are insufficiently charged in the next frame, thereby alleviating phenomena such as the poor vertical lines (V-lines).

DETAILED DESCRIPTION OF THE EMBODIMENTS

The object, technical solutions and advantages of the present invention will be apparent and more readily appreciated from the following description of embodiments taken in conjunction with the accompanying drawings.

According to the present invention, there is provided a gate driving circuit comprising a plurality of cascaded shift register units and a control unit, wherein every two adjacent shift register units constitute a shift register set, and are connected to two gate lines through the control unit, and wherein the control unit controls the shift register units of the shift register set to supply drive signals to the two gate lines, respectively.

Figure 1:
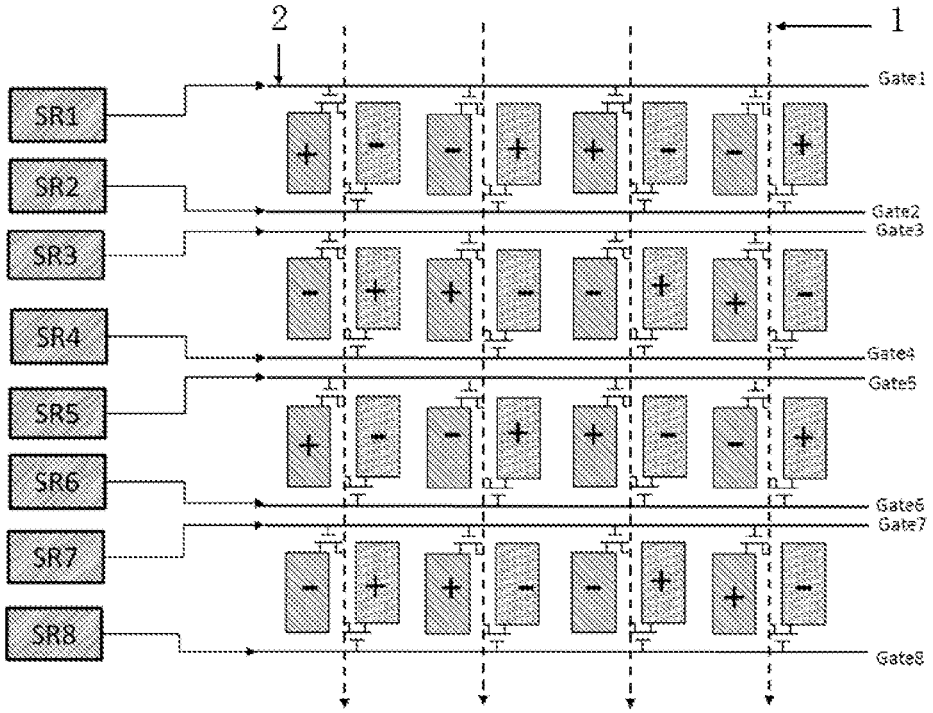
FIG. 1 Prior Art
FIG. 1 is a circuit diagram of an array substrate of a liquid crystal display panel in the prior art.
Figure 2:
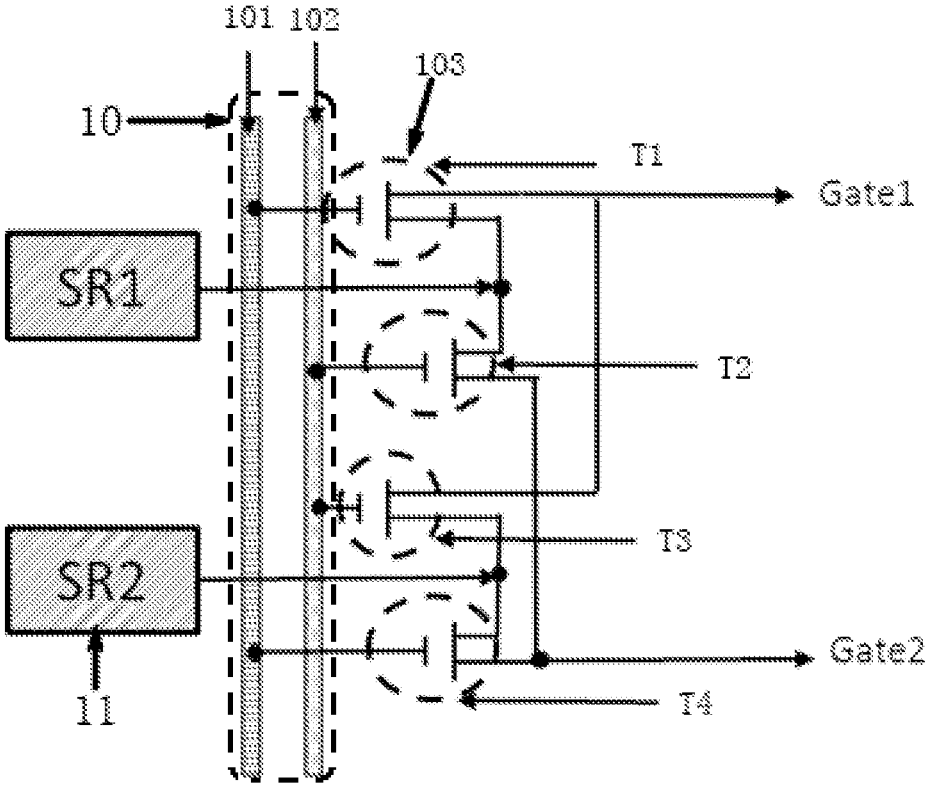
FIG. 2 is a schematic diagram showing a partial configuration of a gate driving circuit in an optional embodiment of the present invention.

FIG. 2 shows a schematic diagram of a partial configuration of a gate driving circuit according to an embodiment of the present invention. As shown in FIG. 2, the gate driving circuit comprises a control unit 10 and a plurality of cascaded shift register units 11. Every two adjacent shift register units constitute a shift register set. In the embodiment, a first shift register set constituted by two shift register units SR1 and SR2 is schematically shown. It should be known by those skilled in the art that a number of the shift register sets is determined according to a size of an array of pixels of a display device. Each shift register set corresponds to two adjacent gate lines Gate1 and Gate 2. The control unit 10 controls supplies of the drive signals from the two shift register units SR1 and SR2 of the shift register set to the two adjacent gate lines Gate1 and Gate 2, respectively.

The control unit 10 comprises a first control line 101, a second control line 102, and a plurality of thin film transistors 103 connected to the shift register units. Every two adjacent shift register units 11 constitute one shift register set, and each shift register unit of each shift register set is connected to the first control line 101 and the second control line 102 through two thin film transistors, respectively. The first shift register unit SR1 of the shift register set is connected to the first control line 101 and the second control line 102 through a first thin film transistor T1 and a second thin film transistor T2 adjacent to each other, respectively. A gate of the first thin film transistor T1 is connected to the first control line 101, and a gate of the second thin film transistor T2 is connected to the second control line 102. Drains of the first thin film transistor T1 and the second thin film transistor T2 are connected to the two adjacent gate lines Gate1 and Gate2, respectively. Sources of the first thin film transistor T1 and the second thin film transistor T2 are connected to an output of the first shift register SR1. Likewise, the second shift register unit SR2 of the first shift register set is connected to the first control line 101 and the second control line 102 through a third thin film transistor T3 and a fourth thin film transistor T4 adjacent to each other, respectively. A gate of the third thin film transistor T3 is connected to the second control line 102, and a gate of the fourth thin film transistor T4 is connected to the first control line 101. Drains of the third thin film transistor T3 and the fourth thin film transistor T4 are connected to the two adjacent gate lines Gate1 and Gate2, respectively. Sources of the third thin film transistor T3 and the fourth thin film transistor T4 are connected to an output of the second shift register unit SR2. As analogized in sequence, every two adjacent shift register units constitute one shift register set, each shift register set corresponds to four thin film transistors, and each shift register unit of each shift register set is connected to the first control line 101 and the second control line 102 through two thin film transistors, respectively.

The control unit 10 controls supplies of the drive signals from the shift register units of the shift register set to different ones of the two adjacent gate lines. According to the above embodiment of the present invention, the first control line 101 and the second control line 102 alternately output high-electric potential drive signals. Optionally, in a current frame scan, the first control line 101 outputs a high-electric potential drive signal and the second control line 102 outputs a low-electric potential drive signal, while in a next frame scan, the first control line 101 outputs a low-electric potential drive signal and the second control line 102 outputs a high-electric potential drive signal.

Figure 3:
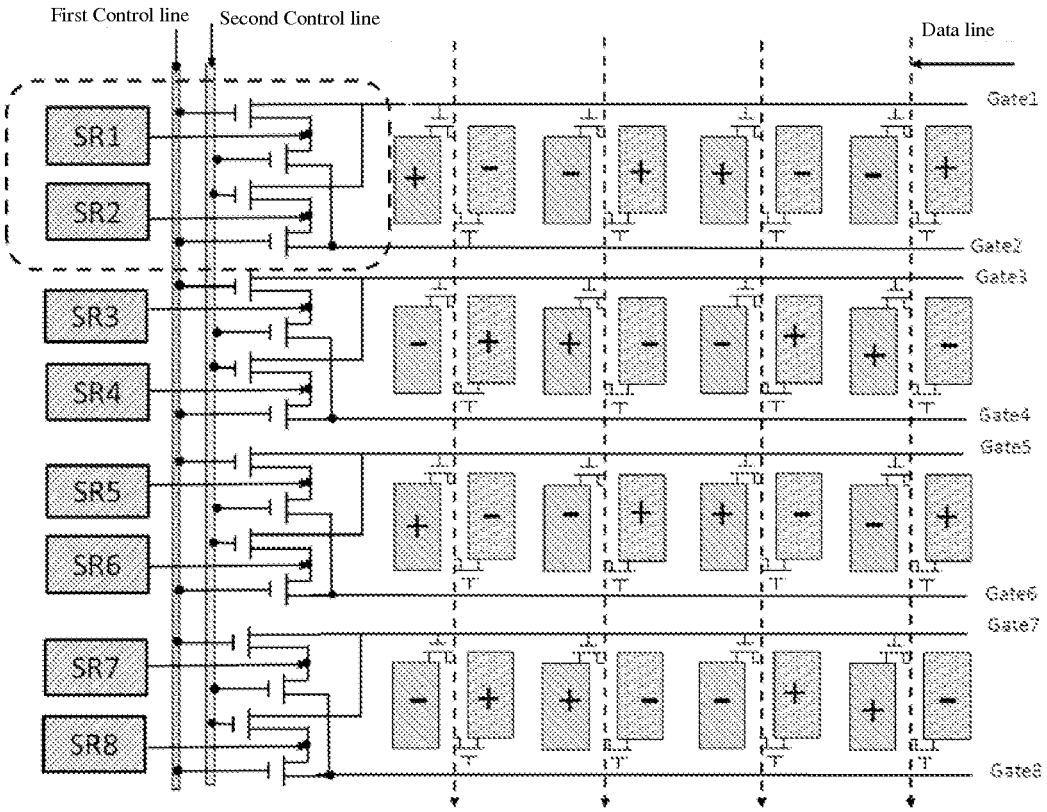
FIG. 3 is a schematic diagram showing a connection between the gate driving circuit and an array of pixel units in the optional embodiment of the present invention.

The two adjacent gate lines Gate1 and Gate2 are connected to pixel units in odd-numbered columns and pixel units in even-numbered columns, of an array of pixel units, respectively. FIG. 3 shows a schematic diagram of a connection between the gate driving circuit and an array of pixel units in the optional embodiment of the present invention. FIG. 3 shows four shift register sets including eight cascaded shift register units SR1-SR8 in total. A portion shown in a dashed-line box in FIG. 3 has the same configuration as a part of a gate driving circuit shown in FIG. 2. As shown in FIG. 3, the two adjacent gate lines Gate1 and Gate2 connected to the first shift register SR1 and the second shift register SR2 of the first shift register set are connected to pixel units in odd-numbered columns and pixel units in even-numbered columns, of an array of pixel units, respectively. The first gate line Gate1 and the pixel units in odd-numbered columns of a first row of the array of pixel units are connected to each other through first pixel unit thin film transistors, the second gate line Gate2 and the pixel units in even-numbered columns of the first row are connected to each other through second pixel unit thin film transistors, and the pixel unit thin film transistors each have a gate connected to the corresponding gate line, a drain connected to a corresponding pixel electrode of the pixel unit, and a source connected to the data line. In this embodiment, every two columns of pixel units constitute a set and are connected to one same data line. In other words, the number of the columns of the pixel units is two times as great as the number of the data lines. A first odd-numbered column of pixel units and a first even-numbered column of pixel unit are connected to a first data line through the pixel unit thin film transistors, and a second odd-numbered column of pixel units and a second even-numbered column of pixel units are connected to a second data line through the pixel unit thin film transistors. Other gate lines and the shift register units of other shift register sets and other pixel units in the array of pixel units are connected in the same manner, and the other pixel units and other data lines are connected to one another through the pixel unit thin film transistors in the same way. Those connections are no longer described for the sake of brevity.

The operation principle of the gate driving circuit according to embodiments of the present invention will now be described with reference to FIGS. 2 and 3.

In a current frame scan, the first control line 101 outputs a high electric potential and the second control line 102 outputs a low electric potential. Since the gates of the first thin film transistor T1 and the fourth thin film transistor T4 are connected to the first control line 101 and the second thin film transistor T2 and the third thin film transistor T3 are connected to the second control line 102, the first thin film transistor T1 and the fourth thin film transistor T4 are turned on. When the frame scan begins, the cascaded shift register units are turned on and off one by one. In a first scanning period of the current frame, the first shift register SR1 is turned on and outputs a pulse signal to the first gate line Gate 1 through the first thin film transistor T1 so that the first pixel unit thin film transistors between the first gate line Gate1 and the pixel units in the odd-numbered columns of the first row are turned on, and the corresponding data lines charge the pixel units in the odd-numbered columns of the first row; and in a second scanning period of the current frame, the first shift register SR1 is turned off, and the second shift register SR2 is turned on and outputs a pulse signal to the second gate line Gate2 through the fourth thin film transistor T4 so that the second pixel unit thin film transistors between the second gate line Gate2 and the pixel units in the even-numbered columns of the first row are turned on, and the corresponding data lines charge the pixel units in the even-numbered columns of the first row. As analogized in sequence, in a third scanning period, the second shift register SR2 is turned off, and the third shift register unit SR3 is turned on and outputs a pulse signal to the third gate line Gate3 so that the pixel unit thin film transistors between the third gate line Gate3 and the pixel units in the odd-numbered columns of the second row are turned on, and the corresponding data lines charge the pixel units in the odd-numbered columns of the second row; and in a fourth scanning period, the third shift register SR3 is turned off, and the fourth shift register SR4 is turned on and outputs a pulse signal to the fourth gate line Gate4 so that the pixel unit thin film transistors between the fourth gate line Gate4 and the pixel units in the even-numbered columns of the second row are turned on, and the corresponding data lines charge the pixel units in the even-numbered columns of the second row. Then, in a fifth scanning period, a sixth scanning period, . . . , a fifth shift register unit SR5, a sixth shift register unit SR6, . . . , are sequentially turned on and output pulse signals to charge the corresponding pixel units in cooperation with the corresponding data lines until the current frame scan is completed. During this frame scan, if the first column of pixel units and the second column of pixel units are taken as an example, the scanning sequence of the pixel units is as follows: the pixel unit in the odd-numbered column, the pixel unit in the even-numbered column, the pixel unit in the odd-numbered column, the pixel unit in the even-numbered column, the pixel unit in the odd-numbered column, the pixel unit in the even-numbered column, . . . , and is like a Z-shaped scan. The other adjacent columns of pixel units have the same scanning sequence.

In a next frame scan, the electric potentials of the drive signals outputted by the first control line 101 and the second control line 102 are opposite to those in the previous frame. In other words, the first control line 101 outputs a low-electric potential drive signal and the second control line 102 outputs a high-electric potential drive signal. Since the gates of the first thin film transistor T1 and the fourth thin film transistor T4 are connected to the first control line 101 while the second thin film transistor T2 and the third thin film transistor T3 are connected to the second control line 102, the second thin film transistor T2 and the third thin film transistor T3 are turned on. When the frame scan begins, the cascaded shift register units are turned on and off one by one. In a first scanning period, the first shift register SR1 is turned on and outputs a pulse signal to the second gate line Gate2 through the second thin film transistor T2 so that the second pixel unit thin film transistors between the second gate line Gate2 and the pixel units in the even-numbered columns of the first row are turned on, and the corresponding data lines charge the pixel units in the even-numbered columns of the first row; and in a second scanning period, the first shift register SR1 is turned off, and the second shift register SR2 is turned on and outputs a pulse signal to the first gate line Gate1 through the third thin film transistor T3 so that the first pixel unit thin film transistors between the first gate line Gate1 and the pixel units in the odd-numbered columns of the first row are turned on, and the corresponding data lines charge the pixel units in the odd-numbered columns of the first row. As analogized in sequence, in a third scanning period, the second shift register SR2 is turned off, and the third shift register unit SR3 is turned on and outputs a pulse signal to the fourth gate line Gate4 so that the pixel unit thin film transistors between the fourth gate line Gate4 and the pixel units in the even-numbered columns of the second row are turned on, and the corresponding data lines charge the pixel units in the even-numbered columns of the second row; and in a fourth scanning period, the third shift register SR3 is turned off, and the fourth shift register SR4 is turned on and outputs a pulse signal to the third gate line Gate3 so that the pixel unit thin film transistors between the third gate line Gate3 and the pixel units in the odd-numbered columns of the second row are turned on, and the corresponding data lines charge the pixel units in the odd-numbered columns of the second row. Then, in a fifth scanning period, a sixth scanning period, . . . , the fifth shift register unit SR5, the sixth shift register unit SR6, . . . , are sequentially turned on and output pulse signals to charge the corresponding pixel units in cooperation with the corresponding data lines until the current frame scan is completed. During this frame scan, if the first column of pixel units and the second column of pixel units are taken as an example, the scanning sequence of the pixel units is as follows: the pixel unit in the even-numbered column, the pixel unit in the odd-numbered column, the pixel unit in the even-numbered column, the pixel unit in the odd-numbered column, the pixel unit in the even-numbered column, the pixel unit in the odd-numbered column, . . . , and is like a reversed Z-shaped scan. The other adjacent columns of pixel units have the same scanning sequence.

Therefore, the gate driving circuit according to embodiments of the present invention can change the charging sequence of the two adjacent columns of pixel units through the control unit, thereby achieving uniform charging. How to achieve uniform charging with the gate driving circuit according to embodiments of the present invention will now be described still with reference to FIGS. 2 and 3. It will be described by an example in which polarities of pixels are inverted in the 1+2-dot inversion manner.

In the 1+2-dot inversion, the data lines each output data signals of different polarities, and the data signal having a voltage greater than a common voltage used as a reference is a positive-polarity data signal while the data signal having a voltage less than the common voltage is a negative-polarity data signal. In a first scanning period, the data line outputs a negative/positive-polarity data signal and a polarity of the pixel units receiving the data signal from the data line is negative/positive after being charged, while in a second scanning period, the polarity of the date signal outputted by the data line is inverted, and the polarity of the pixel units receiving the data signal from the data line is inverted and is positive/negative after being charged; and, in a third scanning period, the polarity of the date signal outputted by the data line is not changed and the polarity of the pixel units receiving the data signal from the data line is not changed either and is positive/negative after being charged, while in a fourth scanning period, the polarity of the date signal outputted by the data line is inverted, and the polarity of the pixel units receiving the data signal from the data line is also inverted and is negative/positive after being charged. As analogized in sequence, the polarity of the date signal outputted by the data line is inverted once every two scanning periods, except the first scanning period. The polarity of the date signal outputted by the data line in the second scanning period is different from that in the first scanning period. Furthermore, the polarities of the date signals outputted by the two adjacent data lines in the same scanning period are different from each other. For example, if the first data line outputs a positive-polarity data signal, the adjacent second data line outputs a negative-polarity data signal.

In the case that the gate driving circuit according to embodiments of the present invention is applied to the 1+2-dot inversion driving and that the first control line 101 outputs a high-electric potential drive signal and the second control line 102 outputs a low-electric potential drive signal, the polarities of the pixel units in the array of pixel units are as shown in FIG. 3 after one frame scan is completed. In FIG. 3, the symbol "+" indicates that the polarity of a pixel electrode of the pixel unit is positive, while the symbol "–" indicates that the polarity of a pixel electrode of the pixel unit is negative. The first odd-numbered column of pixel units and the first even-numbered column of pixel units are taken as an example. In this case, as can be seen, the polarity of the pixel unit in the even-numbered column of the first row and the polarity of the pixel unit in the odd-numbered column of the first row are opposite to each other. When the pixel unit in the even-numbered column of the first row is charged, its polarity is inverted and during such inversion, some of electrons will be necessarily caused to be lost so that the pixel unit in the even-numbered column of the first row is insufficiently charged; and the pixel unit in the odd-numbered column of the second row is the same in polarity as the pixel unit in the even-numbered column of the first row and is sufficiently charged, while the pixel unit in the even-numbered column of the second row is opposite in polarity to the pixel unit in the odd-numbered column of the second row and is insufficiently charged. As analogized in sequence, after this frame scan is completed, all of the odd-numbered column of pixel units are sufficiently charged, while the even-numbered column of pixel units are insufficiently charged.

However, in a next frame scan, the electric potential drive signals of the first control line 101 and the second control line 102 are changed. In other words, the first control line 101 outputs a low-electric potential drive signal and the second control line 102 outputs a high-electric potential drive signal. In this case, the pixel units in the even-numbered columns are first charged and then the pixel units in the odd-numbered columns are charged. In the case where the data signal outputted by the data line has the same polarity as in the previous frame scan, in the first scanning period the pixel unit in the even-numbered column of the first row is changed and has a positive polarity, in a second scanning period the pixel unit in the odd-numbered column of the first row is charged and has a negative polarity, in a third scanning period the pixel unit in the even-numbered column of the second row is charged and has a negative polarity, in a fourth scanning period the pixel unit in the odd-numbered column of the second row is charged and has a positive polarity, and so on. Apparently, in this frame scan, all of the pixel units in the odd-numbered columns are insufficiently charged, while the pixel units in the even-numbered column are sufficiently charged. Therefore, after two consecutive frame scans, charging degrees of the pixel units can be equalized, thereby overcoming poor displaying phenomena such as the vertical lines.

The foregoing embodiment is illustrated schematically. However, the gate driving circuit according to embodiments of the present invention can also control the first control line and the second control line to alternately output a high-electric potential drive signal and a low-electric potential drive signal such that scanning sequences of the pixel units in odd-numbered rows and even-numbered rows of each column are different from each other so long as equal charging can be achieved. For example, in a case where the first odd-numbered column of pixel units and the first even-numbered column of pixel units are taken as an example, the pixel units in the first odd-numbered column are respectively numbered from top to bottom 1, 3, 5, 7, . . . , and the pixel units in the first even-numbered column are respectively numbered from top to bottom 2, 4, 6, 8, . . . . In this case, in the first scanning manner described above, the scanning sequence of the previous frame is 1, 2, 3, 4, 5, 6, 7, 8, . . . , in other words, the scanning is a Z-shaped scan, while the scanning sequence of the next frame is 2, 1, 4, 3, 6, 5, 8, 7, . . . , and in other words, the scanning is a reversed Z-shaped scan. However, the above-mentioned first scanning manner may be changed into a second scanning manner, that is, the scanning sequence of the previous frame is 1, 2, 4, 3, 5, 6, 8, 7, . . . , in other words, the scanning is a 弓 shaped scan, while the scanning sequence of the next frame is 2, 1, 3, 4, 6, 5, 7, 8, . . . , in other words, the scanning is a reversed 弓 shaped scan. Other scanning sequences or a combination of different scanning manners may be adopted in these embodiments of the present invention. For example, the first scanning manner is used for the first and second frames, the second scanning manner is used for the third and fourth frames, and the like. All of technical solutions in which the gate driving circuit according to these embodiments of the present invention is used for achieving equal charging fall within the protection scope of the present invention.

According to embodiments of the present invention, there is also provided a display device comprising the above-mentioned gate driving circuit. The display device further comprises N rows by M columns of pixel units, 2N gate lines, and M/2 data lines. The 2N gate lines and the M/2 data lines cross one another to define the pixel units. Odd-numbered ones of the gate lines are respectively connected to the pixel units in the odd-numbered columns, and even-numbered ones of the gate lines are connected respectively to the pixel units in the even-numbered columns. The pixel units in every two adjacent columns of the odd-numbered columns and the even-numbered columns are connected to a same one of the data lines, and the two gate lines are one of the odd-numbered gate lines and one of the even-numbered gate lines, that are adjacent to each other.

Embodiment of FIG. 3 is still taken as an example for description. The display device according to an embodiment of the present invention comprises a gate driving circuit, an array of pixel units composed of N by M pixel units, 2N gate lines, and M/2 data lines. FIG. 3 schematically shows 4 by 8 (N=4 and M=8) pixel units, 4 data lines, and 8 gate lines Gate1-Gate8. The odd-numbered gate lines (Gate1, Gate3, Gate5, and Gate7) are connected to the pixel units in the odd-numbered columns, and the even-numbered gate lines (Gate2, Gate4, Gate6, and Gate8) are connected to the pixel units in the even-numbered columns. Each data line is connected to the pixel units in the two adjacent columns. For example, the first data line is connected to the pixel units in the first odd-numbered column and the first even-numbered column, the second data line is connected to the pixel units in the second odd-numbered column and the second even-numbered column, and so on. The shift register units of each shift register set in the gate driving circuit are connected to the adjacent odd-numbered and even-numbered gate lines through the control unit. For example, the first shift register unit SR1 and the second shift register unit SR2 are connected to the first gate line Gate1 and the second gate line Gate2 through the control unit.

Since the operational principle of the display device under the control of the gate driving circuit has been described above, it is no longer described for the sake of brevity.

According to embodiments of the present invention, there is also provided a driving method of the abovementioned display device, the driving method comprising:

a current frame scan step: turning on and off the cascaded shift register units in sequence and controlling, by the control unit, supply of a drive signal from the turned-on ones of the shift register units to an odd-numbered or even-numbered one of the two gate lines; and a next frame scan step: turning on and off the cascaded shift register units in sequence and controlling, by the control unit, supply of a drive signal from the turned-on ones of the shift register units to an even-numbered or odd-numbered one of the two gate lines.

The current frame scan step comprises:

turning on a first shift register unit of an n-th shift register set of the shift register sets, and controlling, by the control unit, supply of a drive signal from the turned-on first shift register unit to an odd-numbered one of the two gate lines connected to the first shift register unit, and charging the pixel units in odd-numbered columns of an n-th row through the data lines; and turning on a second shift register unit of the n-th shift register set, and controlling, by the control unit, supply of a drive signal from the turned-on second shift register unit to an even-numbered one of the two gate lines, and charging the pixel units in even-numbered columns of the n-th row through the data lines; and the next frame scan step comprises:

turning on the first shift register unit of the n-th shift register set, and controlling, by the control unit, supply of a drive signal from the turned-on first shift register unit to the even-numbered one of the two gate lines connected to the first shift register unit, and charging the pixel units in the even-numbered of the n-th row through the data lines; and turning on the second shift register unit of the n-th shift register set, and controlling, by the control unit, supply of a drive signal from the turned-on second shift register unit to the odd-numbered one of the two gate lines, and charging the pixel units in the odd-numbered columns of the n-th row through the data lines; and wherein charging polarities of the pixel units in two adjacent ones of the rows are opposite to each other, charging polarities of the pixel units in two adjacent ones of the columns that are connected to a same one of the data lines are opposite to each other, charging polarities of the pixel units in two adjacent ones of the columns that are connected to different ones of the data lines are the same, and n is a natural number less than or equal to N.

Since the operational principle of driving the display device by the gate driving circuit is described in detail in the abovementioned description of the gate driving circuit, it is no longer described in detail and referring to the forgoing contents for the detail.

In summary, with the gate driving circuit, the display device, and a driving method disclosed in these embodiments of the present invention, in the previous frame scan, a charge ratio of the odd-numbered columns of pixel units is more sufficient than that of the even-numbered columns of pixel units; while in the next frame scan, the even-numbered columns of pixel units are charged more sufficiently than the odd-numbered columns of pixel units. In consideration of visual effect, insufficient charging and sufficient charging of the odd-numbered columns of pixel units and the even-numbered columns of pixel units can be compensated to a certain degree. As a result, poor phenomena of generating bright and dark lines such as the vertical lines can be alleviated.

The object, technical solutions, and advantageous effect of the present invention are further described in detailed in the above specific embodiments. It should be appreciated that the above description is only specific embodiments of the present invention and the embodiment is not used to limit the present invention. It will be understood by those skilled in the art that various modifications, equivalent substitutions and improvements may be made therein without departing from the principles and spirit of the present invention and fall within the scope of the present invention.

The invention claimed is:

1. A gate driving circuit comprising:

a plurality of cascaded shift register units; and a control unit, wherein every two shift register units constitute a shift register set and are connected to two gate lines through the control unit, wherein the control unit controls the shift register units of each shift register set to supply drive signals to the two gate lines, and wherein the control unit comprises:

a plurality of pairs of thin film transistors, wherein each of the shift register units of each shift register set is connected to the two gate lines through one pair of thin film transistors of the plurality of pairs of thin film transistors; and a first control line and a second control line for respectively controlling each pair of thin film transistors of the plurality of pairs of thin film transistors such that each pair of thin film transistors of the plurality of pairs of thin film transistors are respectively turned on and off so that the shift register units of each shift register set selectively supply the drive signals to the two gate lines.

2. The gate driving circuit of claim 1, wherein the control unit comprises a first control line, a second control line, and thin film transistors connected to the shift register units.

3. The gate driving circuit of claim 2, wherein each of the shift register units of each shift register set is connected to the first control line and the second control line through two of the thin film transistors, respectively, and the two thin film transistors comprise gates respectively connected to the first control line and the second control line, drains respectively connected to the two gate lines, and sources connected to an output of a corresponding one of the shift register units of the shift register set.

4. The gate driving circuit of claim 1, wherein the control unit controls each of the shift register units of each shift register set to supply the drive signals to the two gate lines in two consecutive frame scans, respectively.

5. The gate driving circuit of claim 2, wherein the first control line and the second control line alternately output high-electric potential drive signals.

6. The gate driving circuit of claim 1, wherein the two gate lines are connected respectively to pixel units in odd-numbered columns and pixel units in even-numbered columns, of an array of pixel units.

7. The gate driving circuit of claim 6, wherein the gate lines and the pixel units are connected to one another through pixel unit thin film transistors, and the pixel unit thin film transistors each have a gate connected to the gate line, a drain connected to a pixel electrode of the respective pixel unit, and a source connected to the data line.

8. A display device comprising: the gate driving circuit of claim 1.

9. The display device of claim 8, wherein the display device comprises N rows by M columns of pixel units, 2N gate lines, and M/2 data lines, wherein the 2N gate lines and the M/2 data lines cross one another to define the pixel units, odd-numbered ones of the gate lines are connected respectively to the pixel units in the odd-numbered columns, even-numbered ones of the gate lines are connected respectively to the pixel units in the even-numbered columns, the pixel units in every two adjacent columns of the odd-numbered columns and the even-numbered columns are connected to a same one of the data lines, and the two gate lines are one of the odd-numbered gate lines and one of the even-numbered gate lines, that are adjacent to each other.

10. A driving method of driving the display device of claim 9, the driving method comprising:

a current frame scan step: turning on and off the cascaded shift register units in sequence and controlling, by the control unit, supply of a drive signal from the turned-on ones of the shift register units to an odd-numbered or even-numbered one of the two gate lines; and a next frame scan step: turning on and off the cascaded shift register units in sequence and controlling, by the control unit, supply of a drive signal from the turned-on ones of the shift register units to an even-numbered or odd-numbered one of the two gate lines.

11. The driving method of claim 10, wherein:

the current frame scan step comprises:

turning on a first shift register unit of an n-th shift register set of the shift register sets, and controlling, by the control unit, supply of a drive signal from the turned-on first shift register unit to an odd-numbered one of the two gate lines connected to the first shift register unit, and charging the pixel units in odd-numbered columns of an n-th row through the data lines; and turning on a second shift register unit of the n-th shift register set, and controlling, by the control unit, supply of a drive signal from the turned-on second shift register unit to an even-numbered one of the two gate lines, and charging the pixel units in even-numbered columns of the n-th row through the data lines; and the next frame scan step comprises:

turning on the first shift register unit of the n-th shift register set, and controlling, by the control unit, supply of a drive signal from the turned-on first shift register unit to the even-numbered one of the two gate lines connected to the first shift register unit, and charging the pixel units in the even-numbered of the n-th row through the data lines; and turning on the second shift register unit of the n-th shift register set, and controlling, by the control unit, supply of a drive signal from the turned-on second shift register unit to the odd-numbered one of the two gate lines, and charging the pixel units in the odd-numbered columns of the n-th row through the data lines; and wherein charging polarities of the pixel units in two adjacent ones of the rows are opposite to each other, charging polarities of the pixel units in two adjacent ones of the columns that are connected to a same one of the data lines are opposite to each other, charging polarities of the pixel units in two adjacent ones of the columns that are connected to different ones of the data lines are the same, and n is a natural number less than or equal to N.

12. The gate driving circuit of claim 1, wherein the one pair of thin film transistors comprise gates respectively connected to the first control line and the second control line, drains respectively connected to the two gate lines, and sources connected to an output of a corresponding one of the shift register units of the shift register set.

13. The gate driving circuit of claim 1, wherein the control unit controls the shift register units of each shift register set to supply the drive signals to the two gate lines in a same frame scan, respectively.

14. The gate driving circuit of claim 1 wherein the first control line and the second control line alternately output high-electric potential drive signals.

15. The gate driving circuit of claim 3, wherein the first control line and the second control line alternately output high-electric potential drive signals.

16. The gate driving circuit of claim 12, wherein the first control line and the second control line alternately output high-electric potential drive signals.

17. The gate driving circuit of claim 1, wherein the two shift register units of the shift register set are disposed adjacent to each other.

* * * * *